US009126381B2

(12) United States Patent
Babcock et al.

(10) Patent No.: US 9,126,381 B2
(45) Date of Patent: Sep. 8, 2015

(54) BOX MAKING MACHINES

(75) Inventors: James B. Babcock, White Hall, MD (US); Yury Polikov, Pikesville, MD (US)

(73) Assignee: SUN AUTOMATION, INC., Sparks, MD (US)

( * ) Notice: Subject to any disclaimer, the term of this patent is extended or adjusted under 35 U.S.C. 154(b) by 610 days.

(21) Appl. No.: 12/807,474

(22) Filed: Sep. 7, 2010

(65) Prior Publication Data

US 2012/0058873 A1 Mar. 8, 2012

(51) Int. Cl.

| | |
|---|---|
| ***B31B 1/88*** | (2006.01) |
| ***B31B 3/74*** | (2006.01) |
| ***B31B 1/00*** | (2006.01) |
| ***B41F 19/00*** | (2006.01) |

(52) U.S. Cl.

CPC ... *B31B 3/74* (2013.01); *B31B 1/00* (2013.01); *B41F 19/008* (2013.01); *B31B 2201/88* (2013.01); *B31B 2201/94* (2013.01)

(58) Field of Classification Search

CPC ..... B31B 1/00; B31B 1/12; B31B 5/02; B31B 11/00; B31B 15/02; B31B 2201/02; B31B 2201/0202; B31B 2217/006

USPC ..... 493/53, 60, 63, 71, 64, 55, 123, 473, 493/477, 321

See application file for complete search history.

(56) References Cited

U.S. PATENT DOCUMENTS

| | | | | |
|---|---|---|---|---|
| 5,004,221 | A * | 4/1991 | Stark | 271/194 |
| 5,168,891 | A * | 12/1992 | Green et al. | 137/114 |
| 5,284,003 | A * | 2/1994 | Goodman et al. | 53/437 |
| 5,531,432 | A * | 7/1996 | Sardella | 271/10.01 |
| 5,582,569 | A * | 12/1996 | Kowalewski et al. | 493/52 |
| 5,782,183 | A * | 7/1998 | Andrews, Jr. | 101/232 |
| 5,993,587 | A * | 11/1999 | Seki et al. | 156/210 |
| 6,179,763 | B1 * | 1/2001 | Phillips, III | 493/60 |
| 6,346,068 | B1 * | 2/2002 | Philips, III | 493/123 |
| 6,412,409 | B2 | 7/2002 | Weishew | |
| 6,913,566 | B2 * | 7/2005 | Polikov et al. | 493/60 |
| 7,096,529 | B2 * | 8/2006 | Cunnington et al. | 15/1.51 |

* cited by examiner

*Primary Examiner* — Sameh Tawfik
(74) *Attorney, Agent, or Firm* — William E. Mouzavires

(57) ABSTRACT

A corrugated box making machine has a vacuum transfer mechanism for moving corrugated boards along a path of conveyance including stations having printing and die cutter mechanisms which operate on the boards. The printing mechanisms include a print and impression cylinder, the latter being mounted in a vacuum housing that also holds drive rolls for moving the boards along the path during which the boards are held against the rolls by vacuum in the housing. The latter is movable substantially above the print cylinder to provide convenient access for maintenance of the print cylinder or replacement of its printing plates.

10 Claims, 6 Drawing Sheets

BOX MAKING MACHINES

BACKGROUND OF THE PRESENT INVENTION

The present invention generally relates to box making machines which, for example, print on and/or slot, crease, or cut corrugated boards as they are conveyed along a horizontal path typically by rolls or endless belts. The boards are printed as they pass in the nip between a print cylinder and an impression cylinder. The print cylinder is equipped with printing dies or plates in the form of letters and/or numerals that form the indicia to be printed upon the boards in ink which is supplied to the print cylinder in any suitable manner typically by an ink roller.

Periodically an operator must access the print cylinder in order to change the print plates for another job to be run through the machine or simply to clean the print cylinder including the printing plates. This requires that the machine be stopped and the operator access the print cylinder. However in the typical box making machine this can be difficult if not awkward because the impression cylinder and the transportation mechanism such as feed or pull rolls are inhibiting if not blocking the desired access to the print cylinder.

In the typical, if not standard box making machine, the height of the path of conveyance of the boards is approximately forty-six inches (46"). In some machines of the prior art, this dimension has been raised to approximately 80" in an effort to provide better access to the print cylinder depending on the type of transportation mechanism of the boards. However this type of machine requires platforms to allow the operators to access anything at boardline such as the feed table, requires that infeed and outfeed devices be elevated and requires that the print cylinder assembly be lowered to the operator for changeover and maintenance. Operator platforms present a hazard to safety while also encumbering the infeed and outfeed areas of the machines. Furthermore they do not alleviate the problem when certain transport mechanisms are being used by the machine. In addition, increasing or decreasing the height of the conveyance path detracts from the ability to accommodate some auxiliary equipment which is fitted for use with standard machines utilizing a conveyance path of forty-six inches.

Some other machines in the prior art use pits in the ground below the machine to allow the print cylinder to be accessed by the operator for setting up printing plates for a new job. However such pits present a safety hazard and while also attracting trash and other waste materials. They also encumber and increase the cost of the machine in the same way as other prior art machines. Furthermore the use of such machines is not adaptable to certain box making machines where the transportation mechanism and the impression cylinder are located in the same housing.

Other box making machines of the prior art are provided in sections that are horizontally movable along the path of conveyance between open positions providing access to the printing and impression cylinders for set-up, and closed positions for operating the machines. These machines increase the cost and require greater areas to accommodate them. The time required to allow an operator access to the print cylinders in these machines is significant as the entire machine must be opened one section at a time. In addition, they are not necessarily adaptable to box making machines whose transportation mechanisms are included in the same housing containing the impression cylinder.

OBJECTS OF THE PRESENT INVENTION

An object of the present invention is to provide improvements in box making machines which provide convenient and rapid access to mechanisms, such as for example, printing mechanisms, for cleaning, repair or changing parts to set up for various jobs to be run through the box making machine. Included herein are such improvements that may also be applied to conventional box making machines including those that utilize a path of conveyance at a standard height above the ground or floor.

Another object of the present invention is to provide novel methods and apparatus for providing access to printing mechanisms in a box making machine which overcome the problems of machines of the prior art noted above.

A still further object of the present invention is to provide a box making machine having improved "vacuum transfer" apparatus for conveying the processed boards through the machine. Included herein is the provision of such a vacuum transfer apparatus that includes an impression cylinder of a printing mechanism but also permits the impression cylinder to be moved away from the print cylinder to allow access to the print cylinder for changing, repairing or cleaning the print plates of the print cylinder.

SUMMARY OF PREFERRED EMBODIMENT OF THE PRESENT INVENTION

In accordance with the present invention, certain parts of a box making machine which lie adjacent a work-performing mechanism such as a printing mechanism or a die cutter, are mounted to be movable sufficiently away from the mechanism to permit convenient access to the mechanism to permit it to be serviced for repair, maintenance, cleaning or replacement of its parts such as printing plates on a print cylinder or cutting dies on a die cutter. When servicing is completed, the displaced parts are returned to their operative positions and operation of the box making machine is restored.

In one preferred form, the present invention is applied to a box making machine which employs a "vacuum transfer" mechanism for moving the boards along the horizontal path of conveyance to stations where the boards are printed by a printing mechanism and then are creased, cut or slotted by a die cutter mechanism. In this embodiment, the vacuum transfer mechanism includes a plurality of rotatable drive rolls along the path of conveyance which engage the boards and drive them along the path. The drive rolls are mounted in a housing overlying the conveyance path. The housing provides a vacuum chamber connected to a vacuum source such as a blower such that vacuum in the chamber draws the boards against the drive rolls to permit the rolls to move the boards along the path. In the present embodiment, the vacuum chamber also houses the impression cylinder of a printing mechanism which includes a print cylinder below the impression cylinder. With the exception of the present invention, a similar vacuum transfer mechanism is disclosed in U.S. Pat. No. 6,346,068 B1 assigned to the assignee of the present application.

In order to provide convenient access to the print cylinder for changing or cleaning its print plates or maintenance, etc., the vacuum transfer housing is mounted for movement above and sufficiently away from the print cylinder to permit the desired access to the print cylinder. When servicing is completed, the housing is returned to its operational position to enable the next production run. In a standard conventional box making machine where the level of the path of conveyance is about forty-six inches (46") above the floor or ground, it is preferred that the vacuum housing be moved about thirty-eight inches (38") above the conveyance path. In other embodiments of the present invention, the vacuum housing should be made to be movable at least about four inches (4") above the conveyance path.

DRAWINGS

Other objects and advantages of the present invention will become apparent from the following more detailed description of the present invention taken in conjunction with the attached drawings in which.

DETAILED DESCRIPTION

Figure 1:
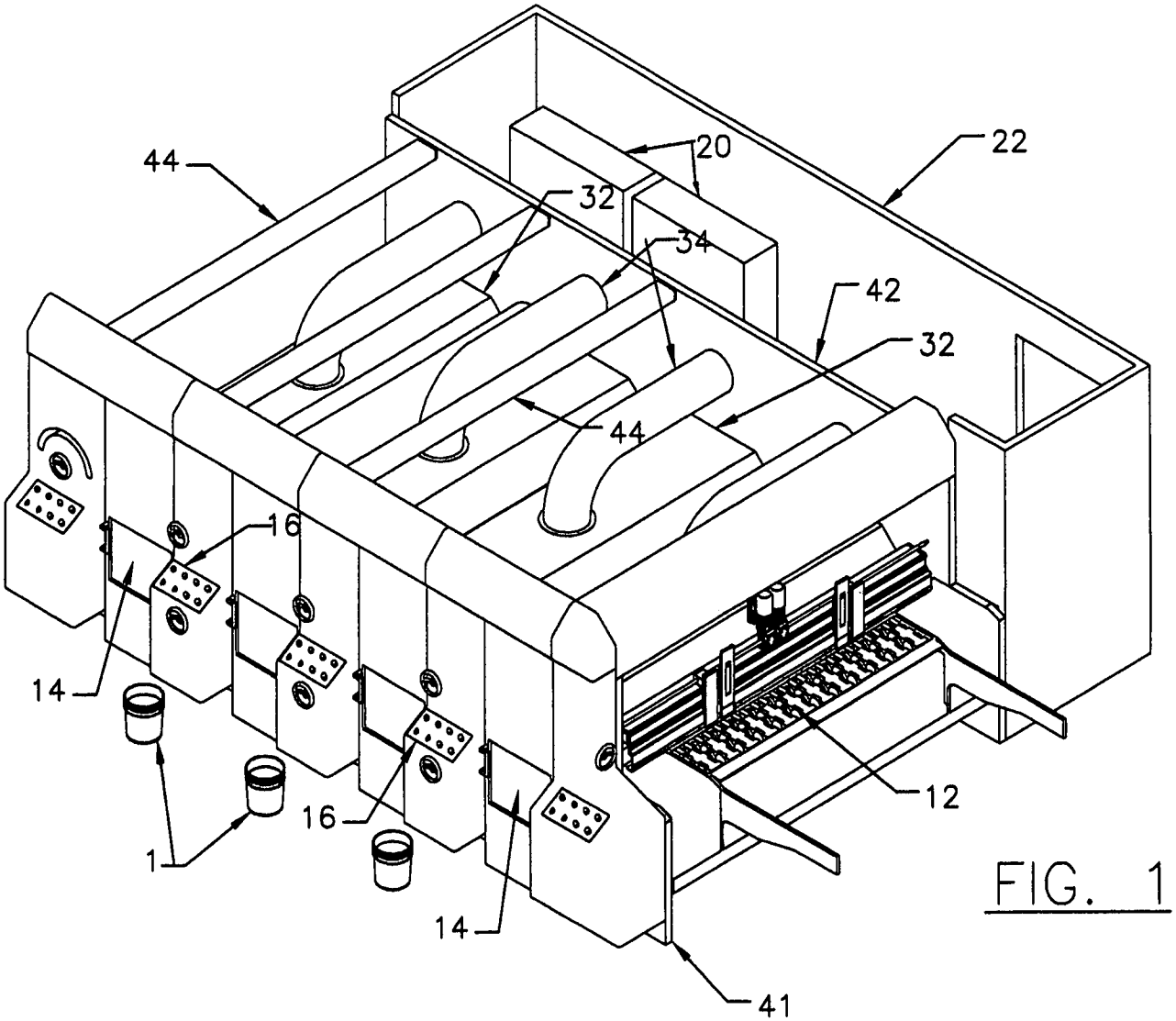
FIG. 1 is a perspective view of a box making machine incorporating one preferred embodiment of the present invention with certain parts omitted for clarity.
Figure 2:
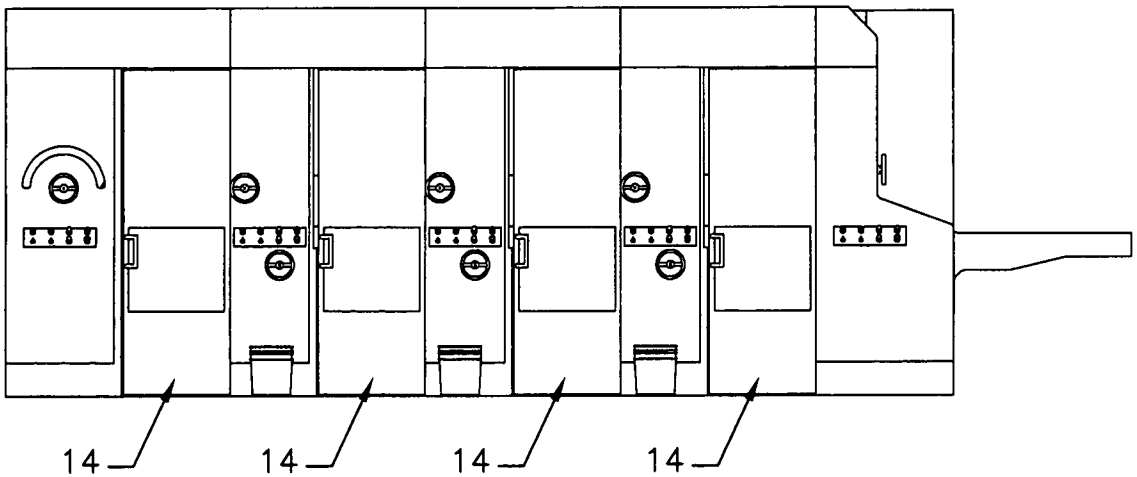
FIG. 2 is a front elevational view of the box making machine.

Referring to the drawings in detail, there is shown for illustrative purposes only, an external perspective view of corrugated box making machine constituting one preferred embodiment of the present invention. Corrugated boards (shown at 10 in FIG. 4) are fed one by one into the inlet by a suitable feeder generally designated 12 such as for example an Extend-o-Feed feeder disclosed in U.S. Pat. No. 5,184,811 which is owned by the assignee of and hereby incorporated by reference into the present application. Access into the machine is through doors 14 shown in FIG. 1 which also shows certain control panels 16 and ink containers 18 at the front side of the machine. FIG. 1 also shows electrical cabinets 20 also shown in FIG. 3 with doors 21; and a guard 22 enclosing the rear side of the machine.

Figure 3:
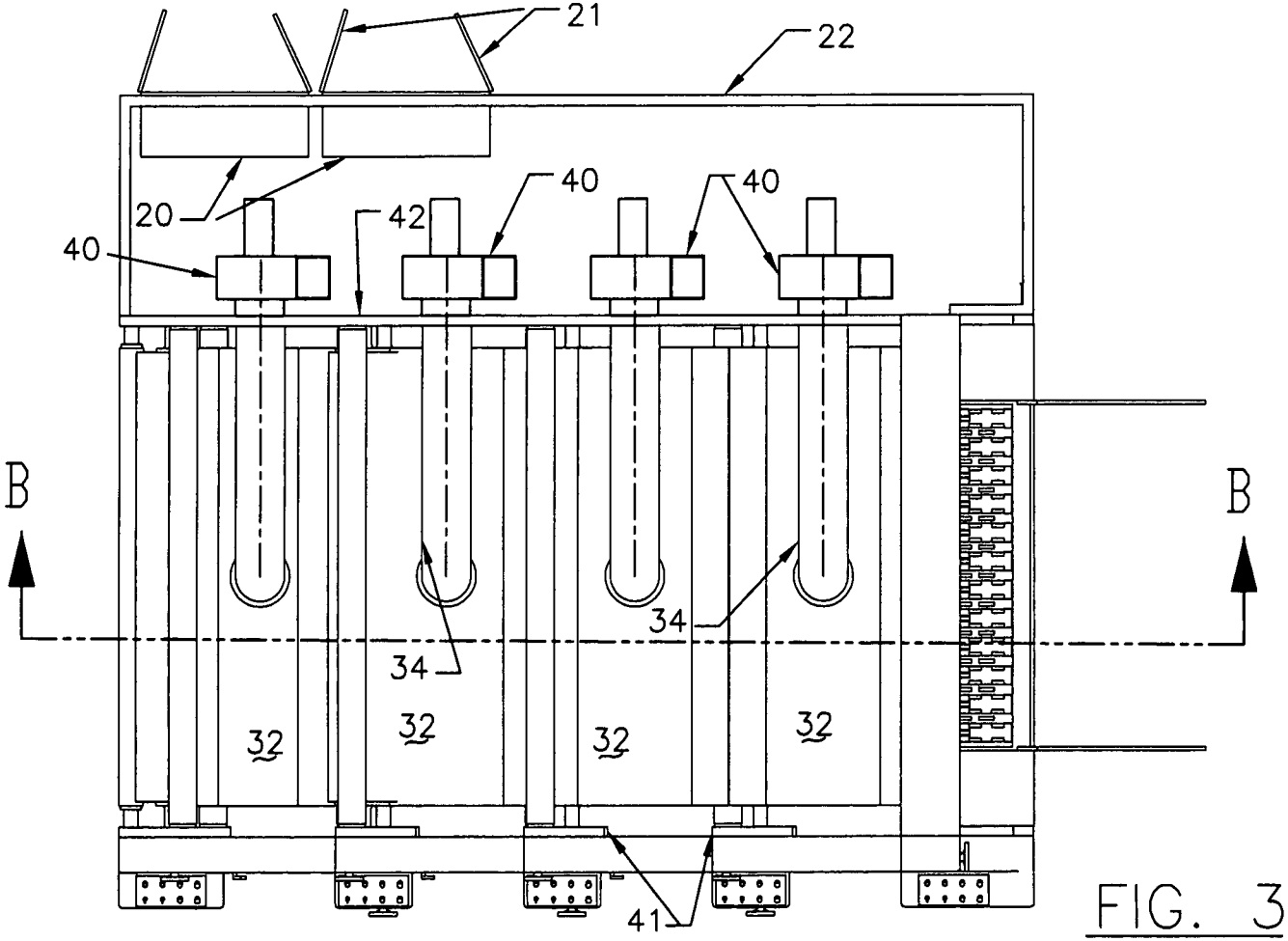
FIG. 3 is a top view of the box making machine.
Figure 4:
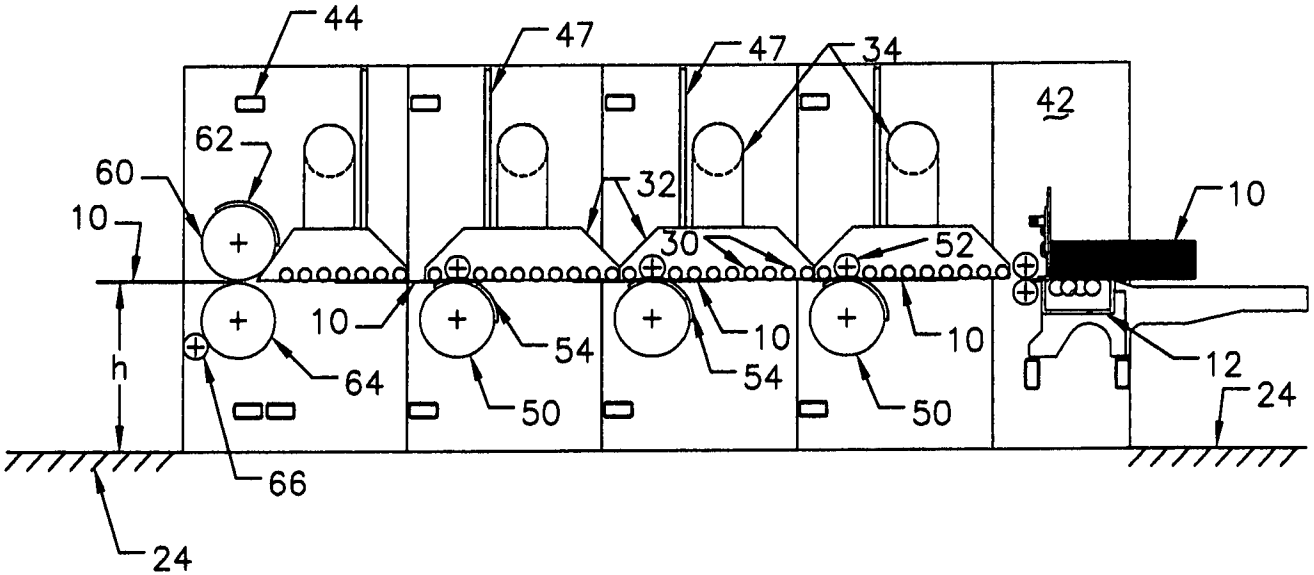
FIG. 4 is a cross-sectional view taken along lines B-B of FIG. 3 showing a vacuum transfer mechanism in an operative position.

The path of conveyance of the boards 10 within the machine coincides with the plane of the boards 10 as shown in FIG. 4. In the preferred embodiment of the present invention the height "h" (see FIG. 4) of the conveyance path above the floor or ground surface 24 is approximately forty-six inches (46") which is generally a standard height in conventional box making machines. In the preferred embodiment shown in FIG. 4, the boards 10 are moved along their path of conveyance by a plurality of friction rolls 30 mounted in a housing 32 and driven in rotation by any suitable means such as servo or other motors and gearing. Boards 10 are held against the rolls 30 by a vacuum generated in housings 32 through air ducts 34 located above housings 32 and communicating with vacuum or air blowers 40 mounted to a fixed vertical support frame or wall 42 as shown in FIG. 3. Support wall 42 is tied to the support wall at the front side of the machine by beams 44 shown in FIG. 1.

Referring to FIG. 4, after boards 10 are conveyed one by one downstream from feeder 12, rolls 30 drive the boards to one or more printing stations where indicia is printed on them by printing mechanisms each including a rotatable cylinder 50 mounted to and between frames 41 and 42, and a rotatable impression cylinder 52 mounted in and to the vacuum housings 32. The boards 10 pass into the nips between the cylinder 50,52 while an inked print plate(s) 54 on print cylinder 50 impresses its indicia on the boards 10 in well known mariner. Ink is supplied to print cylinder 50 by an ink roll 56 shown in FIG. 5. A similar printer mechanism and vacuum transfer unit is disclosed in U.S. Pat. No. 6,346,068 identified above and whose disclosure is hereby incorporated by reference into the present application as part hereof.

When boards 10 leave the last print station, they are conveyed to a die cutter station where a rotary die cutter mechanism cuts, slots and/or creases the boards 10. The rotary die cutter mechanism may be any conventional mechanism including a rotatable die cylinder 60 having one or more dies 62 on its surface and an underlying rotatable anvil 64 which is a cylinder. Boards 10 pass between the die cylinder 60 and anvil 64, and the die 62 cuts, creases and/or slots the boards as they pass through. FIG. 4 also shows an abrading or grinding mechanism including an abrading cylinder which is engageable with the surface of the anvil 64 to keep its diameter uniform. A more detailed description of the above die mechanism 60,64 and the abrading mechanism 66 may be respectively found in U.S. Pat. Nos. 6,913,566 B2 and 6,179,763 B1 assigned to the assignee of the present application and whose disclosures are hereby incorporated by reference into the patent application as part hereof.

Figure 5:
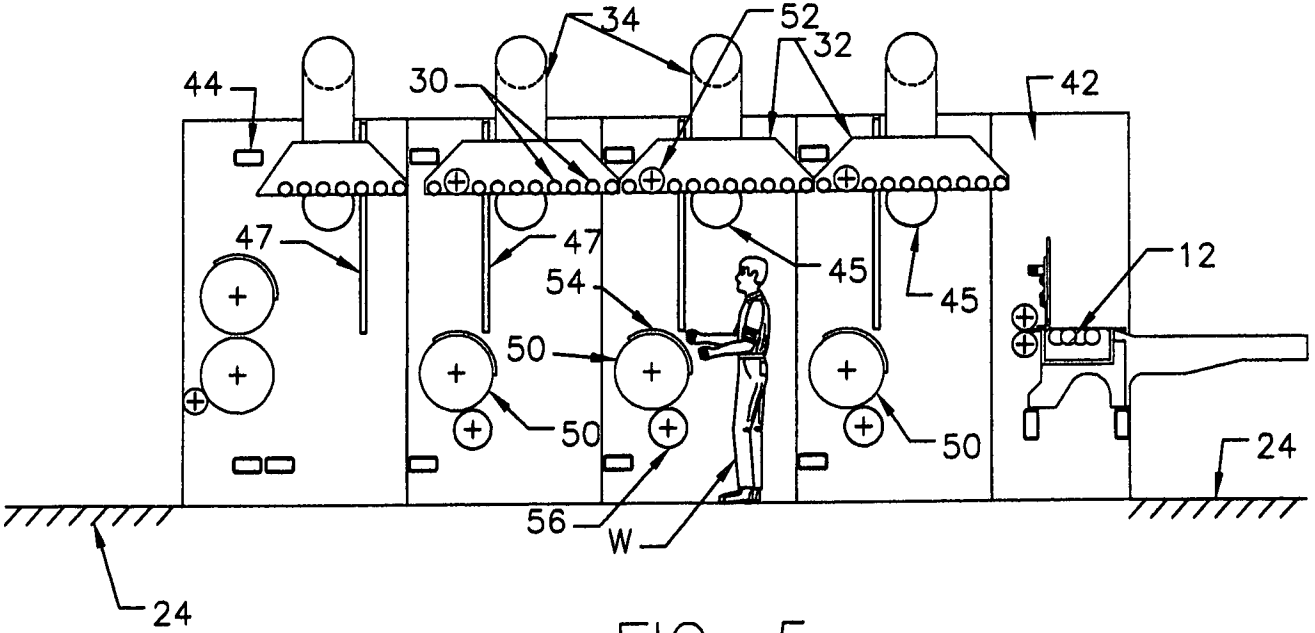
FIG. 5 is a view similar to FIG. 4 but showing the vacuum transfer mechanism in an inoperative raised position allowing access to the print cylinder in accordance with the present invention.
Figure 6:
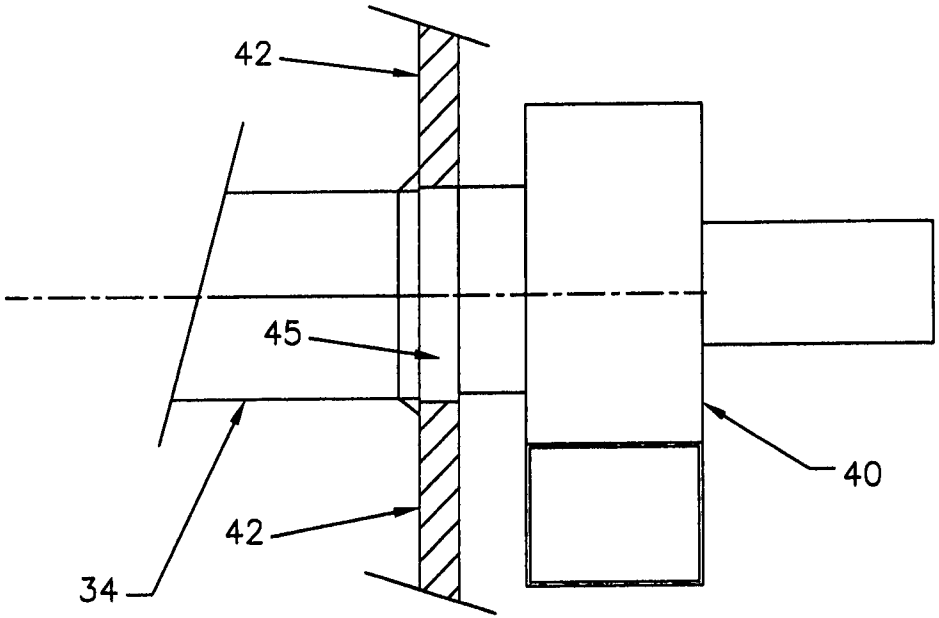
FIG. 6 is a fragmental, cross-sectional view showing a vacuum conduit and blower that is included in the machine.

Referring to FIG. 4, when maintenance of the printing cylinders 50 and/or their printing plates 54 is required or when the printing plates 54 need to be replaced for a new job to be run through the machine, machines of the prior art have not provided the desired convenient access internally of the machine and to the print cylinder 52. This is caused by the proximate position relative to the print cylinder 50 of the vacuum housings 32 and their impression cylinder 52 and drive rolls 30 as best shown in FIG. 4. To overcome this problem in accordance with the present invention, the vacuum housings 32 are mounted for vertical movement between operative position adjacent the path of conveyance and the print cylinder 50 as shown in FIG. 4 and an inoperative position shown in FIG. 5 raised above the latter by at least twelve inches (12") but preferably thirty-eight inches (38") in the preferred embodiment shown and described herein. This provides convenient access to the printing cylinders 50 as illustrated by the worker (W) depicted in FIG. 5 and who easily enters the machine through the doors 14. When the worker has concluded his maintenance or replacement of parts and exited the machine, the vacuum housing 32 is simply returned downwardly to its operative position shown in FIG. 4. Vacuum conduits 34 shown as tubes move with their associated housings 32 between the upper and lower positions described above. For this reason the support wall 42 is apertured at 45 to allow communication between the conduits 34 and vacuum blowers 40 (as best shown in FIG. 6) when the housing is in its operative position. The ends of ducts 34 terminate at the support frame wall 42 along which the ducts move when the vacuum housing 32 is moving between its operative and inoperative positions. In the operative position, the duct 34 registers with aperture 45 in the wall 42 as shown in FIG. 6 to thus communicate with the associated blower 40. In their inoperative, raised position the ducts 34 are out of registry with the apertures 45 as shown in FIG. 5.

Any suitable means may be used to actuate the vacuum housings 32 between their upper and lower positions. In one embodiment, a non-rising screw is received in a nut fixed to the housing 32 such that rotation of the screw by a motor will cause the housing 32 to move along the screw into the desired position. In the specific embodiment shown the housings 32 are guided in their aforementioned movement by vertical guide rails 47 fixed to frame wall 42 as shown in FIGS. 4 and 5. Housings 32 are each provided with "U" shaped guides (not shown) receiving the guide rails 47 for guiding the housings 32 in their vertical movement.

Although shown and described above to access the print cylinder, it will be apparent that the present invention may be applied to access other mechanisms in a box making machine such as the die cutter 60.64 shown in FIG. 4. Moreover the present invention may be applied to box making machines which utilize other transport mechanisms such as endless belts. Therefore although one form of the present invention has been shown and described above, other forms will be apparent to those of ordinary skill in the art but without departing from the scope of the present invention indicated in the appended claims.

We claim:

1. In a corrugated box making machine having a generally horizontal path of conveyance and at least one work station positioned along said path and including a work means operable on boards conveyed along said path, said work means including a printing mechanism including a print cylinder and an impression cylinder overlying the print cylinder; the combination including a board transfer mechanism including a transfer means engageable with the boards to move the boards along said path to said work station, said transfer means having an operative position adjacent said path of conveyance and said print cylinder for transferring boards along said path and an inoperative position spaced at least twelve inches above said print cylinder providing a space for a user to access said print cylinder for maintenance or replacement of said print cylinder, and means for moving said transfer means between said operative and inoperative positions, and wherein said impression cylinder is mounted to and movable with said transfer means between said operative and inoperative positions.

2. The combination defined in claim 1 wherein said transfer means includes a chamber above said conveyance path, and there is further included means for generating a vacuum in said chamber for drawing said boards on said transfer means.

3. The combination defined in claim 2 wherein said means for generating a vacuum includes a vacuum blower, and a duct connected at one end to said chamber and movable with said transfer means between an operative position communicating with said blower and an inoperative position spaced from and out of communication with said blower.

4. The machine defined in claim 2 further including a vertical support structure, a housing defining said chamber, and guide means on said vertical support structure and said housing for guiding movement of said housing between said operative and inoperative positions.

5. The combination defined in claim 1 wherein said transfer means includes a chamber above said conveyance path, and there is further included means for generating a vacuum in said chamber for drawing said boards on said transfer means, and wherein said print cylinder and transfer means are located in said chamber.

6. The combination defined in claim 1 wherein said operative and inoperative positions of said transfer means are spaced at least thirty-eight inches from each other.

7. The machine defined in claim 1 further including a vertical support structure, and guide means on said transfer means and vertical support structure for guiding said transfer means between said operative and inoperative positions.

8. The box machine defined in claim 1 including a plurality of work stations and transfer means associated with each other and spaced along said path of conveyance, a plurality of spaces along said path and respectively located between said work means and dimensioned to receive a standing worker personnel for accessing a work means when said transfer means is in said inoperative position.

9. The box machine defined in claim 1 further including a support structure and wherein said transfer means includes a vacuum housing movable between said operative and inoperative positions of the transfer means, a vacuum conduit on said vacuum housing and having one end in communication with a vacuum chamber in said vacuum housing, said support structure having a port for communicating with another end of said vacuum conduit when said transfer means is in said operative position.

10. The box machine defined in claim 9 wherein said other end of the vacuum conduit is movable along said support structure into and out of communication with said port in said support structure when said transfer means moves into and out of said operative and inoperative positions.

* * * * *